US011661940B2

(12) United States Patent
Lv et al.

(10) Patent No.: US 11,661,940 B2
(45) Date of Patent: May 30, 2023

(54) SCROLL COMPRESSOR HAVING COOLING PIPE MOVING SYNCHRONOUSLY WITH ORBITING SCROLL AND ROTATING WITH RESPECT TO CRANKSHAFT

(71) Applicant: GREE GREEN REFRIGERATION TECHNOLOGY CENTER CO., LTD. OF ZHUHAI, Guangdong (CN)

(72) Inventors: Gang Lv, Zhuhai (CN); Huijun Wei, Zhuhai (CN); Qi Fang, Zhuhai (CN); Shuanglai Liu, Zhuhai (CN); Yuchen Zhao, Zhuhai (CN)

(73) Assignee: GREE GREEN REFRIGERATION TECHNOLOGY CENTER CO., LTD. OF ZHUHAI, Guangdong (CN)

( * ) Notice: Subject to any disclaimer, the term of this patent is extended or adjusted under 35 U.S.C. 154(b) by 0 days.

(21) Appl. No.: 17/285,461

(22) PCT Filed: Sep. 24, 2019

(86) PCT No.: PCT/CN2019/107557
§ 371 (c)(1),
(2) Date: Apr. 14, 2021

(87) PCT Pub. No.: WO2020/114044
PCT Pub. Date: Jun. 11, 2020

(65) Prior Publication Data

US 2021/0381507 A1 Dec. 9, 2021

(30) Foreign Application Priority Data

Dec. 6, 2018 (CN) ..... 201811490258.9

(51) Int. Cl.
*F03C 2/00* (2006.01)
*F03C 4/00* (2006.01)
(Continued)

(52) U.S. Cl.
CPC ..... *F04C 29/023* (2013.01); *F04C 15/0096* (2013.01); *F04C 18/0215* (2013.01);
(Continued)

(58) Field of Classification Search
CPC ..... F04C 18/0215; F04C 18/0223; F04C 18/0261; F04C 18/0292; F04C 15/0096;
(Continued)

(56) References Cited

U.S. PATENT DOCUMENTS 3,802,809 A 4/1974 Vulliez
5,076,771 A * 12/1991 Ban ..... F04C 29/02 418/55.6

(Continued)

FOREIGN PATENT DOCUMENTS

CN 101900116 A 12/2010
CN 102345601 A 2/2012

(Continued)

OTHER PUBLICATIONS

DE19620477A1—Dittmar—Scroll Compressor for Refrigeration or Cooling—Nov. 27, 1997—the English Machine Translation (Year: 1997).*

(Continued)

*Primary Examiner* — Theresa Trieu
(74) *Attorney, Agent, or Firm* — J. Miguel Hernandez; James R. Gourley; Carstens, Allen & Gourley, LLP

(57) ABSTRACT

A compressor includes an orbiting scroll, a cooling pipe and a crankshaft, the cooling pipe includes an inlet pipe and an outlet pipe, an axial through hole is provided at a center of the orbiting scroll, a sealing portion of the orbiting scroll is provided with a sealing groove, a mounting hole is provided in the crankshaft, the cooling pipe passes through the crankshaft and enters from a tail portion of the crankshaft, through the mounting hole, the axial through hole and the (Continued)

sealing groove, and then returns back on the same way, and a part of the cooling pipe is arranged in the sealing portion of the orbiting scroll, the cooling pipe moves synchronously with the orbiting scroll and rotates with respect to the crankshaft.

15 Claims, 6 Drawing Sheets

(51) Int. Cl.

| | |
|---|---|
| ***F04C 18/00*** | (2006.01) |
| ***F04C 15/00*** | (2006.01) |
| ***F04C 29/02*** | (2006.01) |
| ***F04C 18/02*** | (2006.01) |
| ***F04C 29/04*** | (2006.01) |

(52) U.S. Cl.
CPC ..... *F04C 18/0223* (2013.01); *F04C 18/0261* (2013.01); *F04C 18/0292* (2013.01); *F04C 29/04* (2013.01); *F04C 2240/603* (2013.01); *F04C 2240/806* (2013.01); *F04C 2240/809* (2013.01)

(58) Field of Classification Search
CPC .. F04C 23/0008; F04C 27/005; F04C 29/023; F04C 29/04; F04C 2240/603; F04C 2240/806; F04C 2240/809; F01C 19/005
See application file for complete search history.

(56) References Cited

U.S. PATENT DOCUMENTS

| | | | | | |
|---|---|---|---|---|---|
| 5,660,539 | A * | 8/1997 | Matsunaga | F04C 29/023 | 418/94 |
| 5,931,650 | A | 8/1999 | Yasu et al. | | |
| 6,071,100 | A | 6/2000 | Yamada et al. | | |
| 6,135,738 | A * | 10/2000 | Kajiwara | F04C 29/023 | 418/94 |
| 2004/0247474 | A1 * | 12/2004 | Kitaura | F04C 29/023 | 418/94 |
| 2011/0129378 | A1 * | 6/2011 | Hasegawa | F04C 18/0215 | 418/55.1 |
| 2015/0030487 | A1 * | 1/2015 | Toyama | F04C 29/025 | 418/55.6 |

FOREIGN PATENT DOCUMENTS

| | | | | | |
|---|---|---|---|---|---|
| CN | 205260322 | U | | 5/2016 | |
| CN | 206280258 | U | * | 6/2017 | F04C 29/02 |
| CN | 207945087 | U | | 10/2018 | |
| CN | 109386463 | A | | 2/2019 | |
| CN | 209278126 | U | | 8/2019 | |
| DE | 19620477 | A1 | * | 11/1997 | F04C 29/02 |
| JP | H07174084 | A | | 7/1995 | |
| JP | 2012-057595 | A | * | 3/2012 | F04C 29/02 |
| KR | 20120048077 | A | | 5/2012 | |

OTHER PUBLICATIONS

JP2012-057595A—Sotoyama et al.—Compressor and Refrigeration Apparatus—Mar. 22, 2012—the English Machine Translation. (Year: 2012).*

CN206280258U—Tang et al.—Lubricating Structure of Scroll Compressor Vortex Dish—Jun. 27, 2017—the English Machine Translation. (Year: 2017).*

Extended European Search Report for European Application No. 19891831.0 dated Oct. 15, 2021 (9 pages).

* cited by examiner

SCROLL COMPRESSOR HAVING COOLING PIPE MOVING SYNCHRONOUSLY WITH ORBITING SCROLL AND ROTATING WITH RESPECT TO CRANKSHAFT

CROSS REFERENCE TO RELATED APPLICATION

The present application claims priority to Chinese Patent Application with No. 201811490258.9, entitled "Compressor", and filed on Dec. 6, 2018, the content of which is expressly incorporated herein by reference in its entirety. This application is a U.S. national phase of International Application No. PCT/CN2019/107557, entitled "Compressor" filed on Sep. 24, 2019, published as WO 2020/114044 A1 on Jun. 11, 2020. Every patent application and publication listed in this paragraph is hereby incorporated by reference in its entirety.

TECHNICAL FIELD

The present disclosure relates to the field of air compression technology, and particularly to a compressor.

BACKGROUND

The maximum working pressure of the oil-free air scroll compressor is approximately 1.0 MPa, the pressure ratio reaches 10. When an air-cooled device is employed to cool the orbiting and stationary scrolls, and the exhaust temperature at the maximum working pressure reaches 170° C. There is a sealing groove provided on the top of the orbiting and stationary scrolls, and a sealing component are provided inside the sealing groove. The sealing component is required to have higher temperature resistance. The material of the sealing component is required to withstand a high temperature of 200° C. or more, and meanwhile have good wear resistance. During the operation of the compressor, the sealing component is liable to melt at a high temperature, which makes the whole machine unable to pump air.

SUMMARY

In view of this, the technical problem to be solved by the present disclosure is to provide a compressor capable of effectively reducing the temperature at the sealing component.

In order to address the above technical problem, a compressor is provided, which includes an orbiting scroll, a cooling pipe and a crankshaft, the cooling pipe passes through the crankshaft, and a part of the cooling pipe is arranged in a sealing portion of the orbiting scroll, the cooling pipe moves synchronously with the orbiting scroll and rotates with respect to the crankshaft.

In some embodiments, a pressure difference is formed between an inlet and an outlet of the cooling pipe, such that a coolant liquid flows from the inlet through the sealing portion and out of the outlet.

In some embodiments, an axial through hole is provided in a center of the orbiting scroll, the sealing portion of the orbiting scroll is provided with a sealing groove, the crankshaft is provided with a mounting hole, the sealing groove is in communication with the mounting hole through the axial through hole, the cooling pipe enters a tail portion of the crankshaft, and passes through the mounting hole, the axial through hole and the sealing groove, and then returns back on the same way and extends from the tail portion of the crankshaft.

In some embodiments, an eccentric amount of the mounting hole with respect to a central axis of the crankshaft is equal to an eccentric amount of the orbiting scroll with respect to the central axis of the crankshaft.

In some embodiments, the mounting hole is a round hole, and/or, the axial through hole is a round hole.

In some embodiments, the sealing portion further includes a sealing component arranged in the sealing groove, a mounting groove configured to mount the cooling pipe is formed between the sealing component and the sealing groove, and the cooling pipe is in contact with the sealing component.

In some embodiments, a width of the mounting groove is greater than a diameter of the cooling pipe and less than 1.5 times the diameter of the cooling pipe.

In some embodiments, the mounting groove is a rectangular groove or an elliptical groove, and an inlet pipe and an outlet pipe of the cooling pipe are arranged side by side in the mounting groove.

In some embodiments, a tail portion of the sealing groove is bent in an arc shape.

In some embodiments, the compressor further includes a coolant liquid tank, the coolant liquid tank includes a first cavity and a second cavity separated by a partition plate, the partition plate is provided with a throttle hole, the first cavity is in communication with the second cavity through the throttle hole, the outlet of the cooling pipe extends into the first cavity, the inlet of the cooling pipe extends into the second cavity, the outlet of the cooling pipe is lower than the inlet of the cooling pipe, and the inlet and the outlet of the cooling pipe are capable of simultaneously extending below a liquid level.

In some embodiments, the outlet of the cooling pipe is located below the liquid level in the first cavity, the crankshaft has a first rotation angle making the inlet of the cooling pipe located below the liquid level in the second cavity and a second rotation angle making the inlet of the cooling pipe located above the liquid level in the second cavity.

In some embodiments, a top of the first cavity is provided with a connection port, the first cavity is in communication with an exhaust pressure through the connection port, and/or, a top of the second cavity is provided with an opening, the second cavity is in communication with atmosphere through the opening.

In some embodiments, a bottom end of the partition plate is provided with a communication port connecting the first cavity and the second cavity.

In some embodiments, the cooling pipe is a flexible pipe.

In some embodiments, the cooling pipe in the mounting hole is sheathed with a protective sleeve.

In some embodiments, the inlet pipe and outlet pipe of the cooling pipe are respectively sheathed with the protective sleeves, the protective sleeve outside the inlet pipe extends to a pendulous section of the inlet pipe, and the protective sleeve outside the outlet pipe extends to a pendulous section of the outlet pipe.

The compressor provided by the present disclosure includes an orbiting scroll, a cooling pipe and a crankshaft; the cooling pipe passes through the crankshaft, and a part of the cooling pipe is arranged in the sealing portion of the orbiting scroll; the cooling pipe moves synchronously with the orbiting scroll and rotates with respect to the crankshaft. The cooling pipe is arranged in the sealing portion of the orbiting scroll of the compressor, thus the sealing component of the sealing portion can be cooled more effectively by the cooling pipe located in the sealing portion, and the cooling effect is better, thereby preventing the sealing components of the orbiting and stationary scrolls from being easy to wear and melt when operating in a higher temperature environment, and accordingly effectively prolonging the service life of the sealing component and improving the overall reliability. At the same time, because the cooling pipe can move synchronously with the orbiting scroll and rotate with respect to the crankshaft, the arrangement of the cooling pipe in the orbiting scroll can be implemented smoothly without affecting the operation of the orbiting scroll, and meanwhile the orbiting scroll can be cooled more fully, which effectively solves the problem in the prior art that the arrangement of the cooling water pipe in the orbiting scroll is difficult to implement due to the limitation of the motion state of the orbiting scroll.

Reference signs are provided as follows:

1, orbiting scroll; 2, bracket; 3, crankshaft; 32, tail portion of the crankshaft; 34, eccentric portion of the crankshaft; 4, drive motor; 5, coolant tank; 6, partition plate; 7, connection port; 8, opening; 9, inlet pipe; 10, outlet pipe; 11, sealing component; 12, throttle hole; 13, first cavity; 14, second cavity; 15, sealing groove; 152, tail portion of the sealing groove; 16, axial through hole; 17, mounting hole; 18, mounting groove; 19, communication port; w, width of the mounting groove; d, diameter of the cooling pipe.

DETAILED DESCRIPTION

Figure 1:
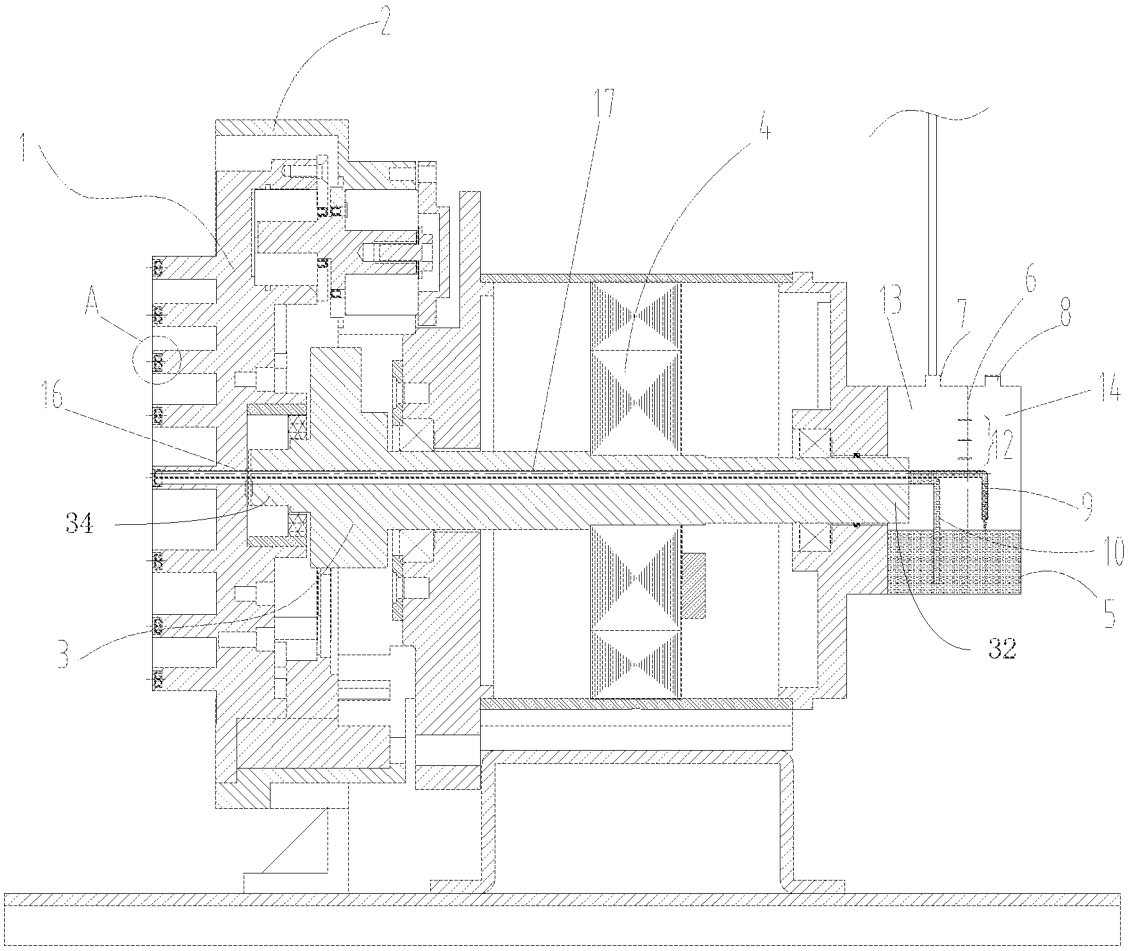
FIG. 1 is a cross-sectional view of a compressor in a first state according to some embodiments of the present disclosure.
Figure 2:
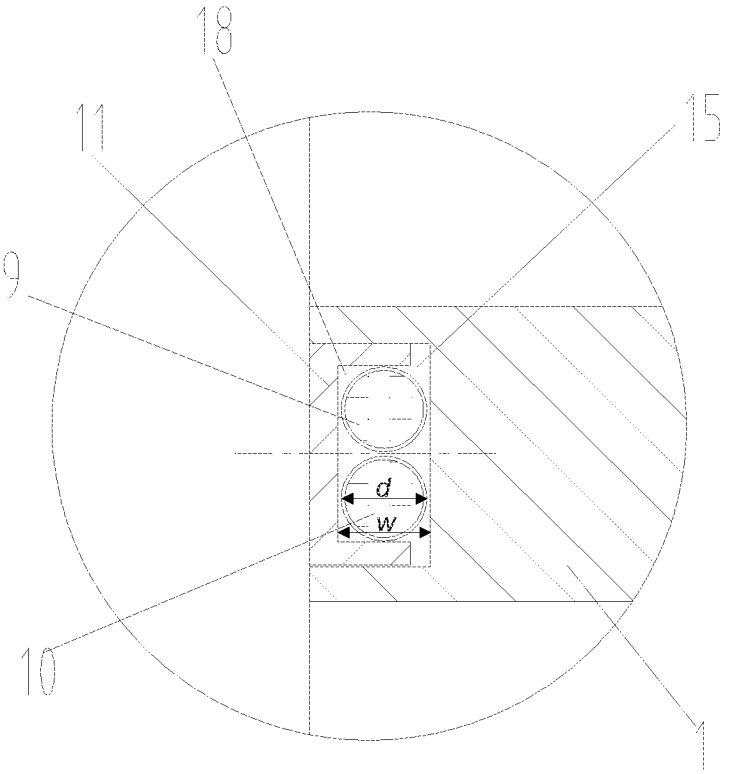
FIG. 2 is an enlarged structure diagram of a portion A in FIG. 1.
Figure 3:
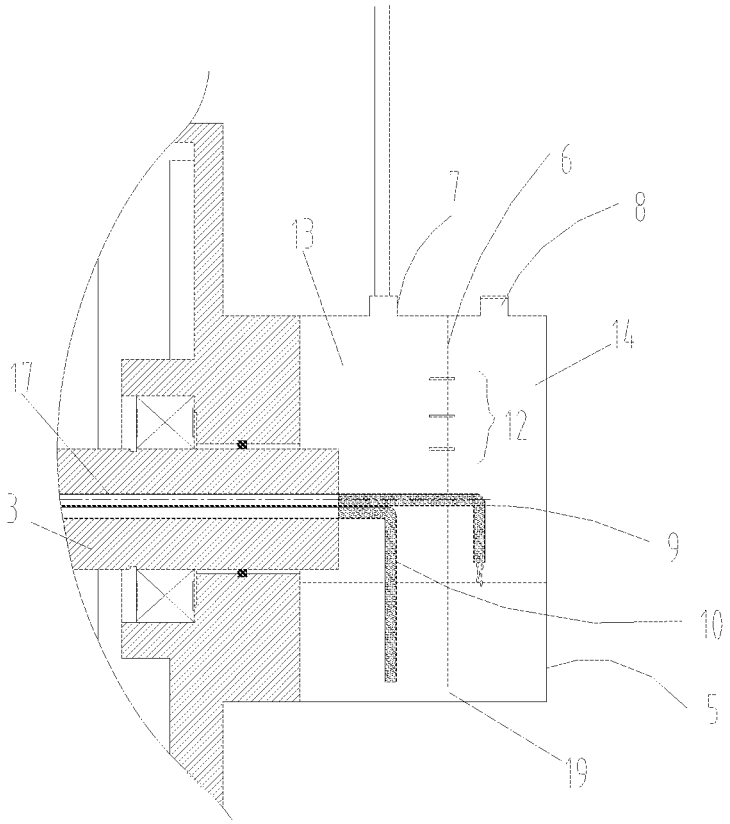
FIG. 3 is a partial enlarged view illustrating an end of a crankshaft of the compressor in FIG. 1.
Figure 4:
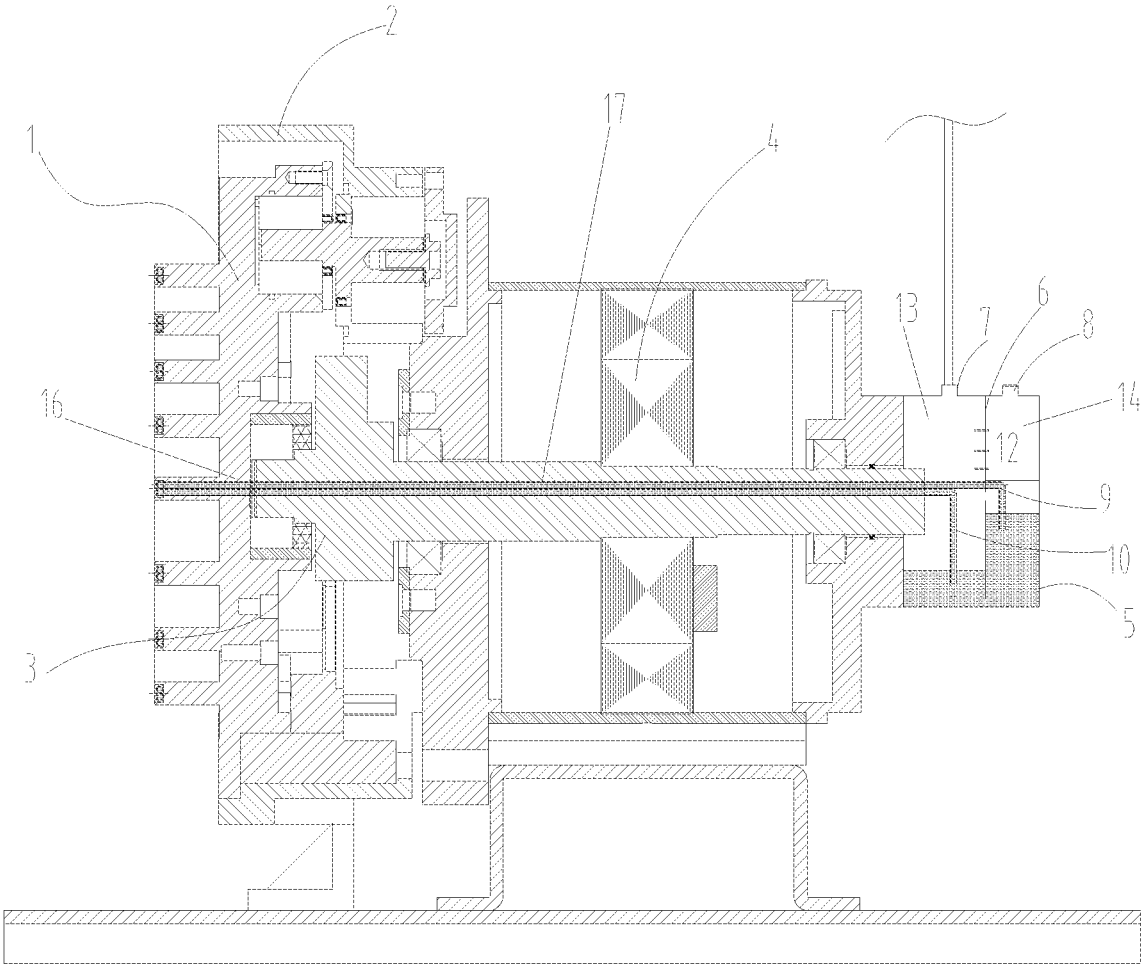
FIG. 4 is a cross-sectional view of a compressor in a second state according to some embodiments of the present disclosure.
Figure 5:
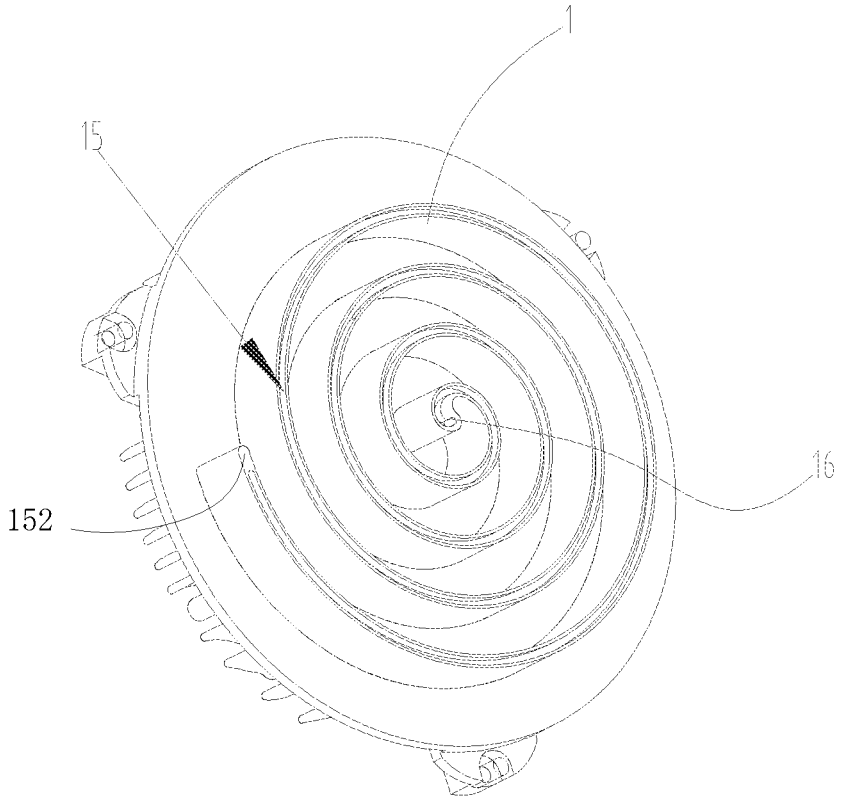
FIG. 5 is a three-dimensional structure diagram of an orbiting scroll of a compressor according to some embodiments of the present disclosure.
Figure 6:
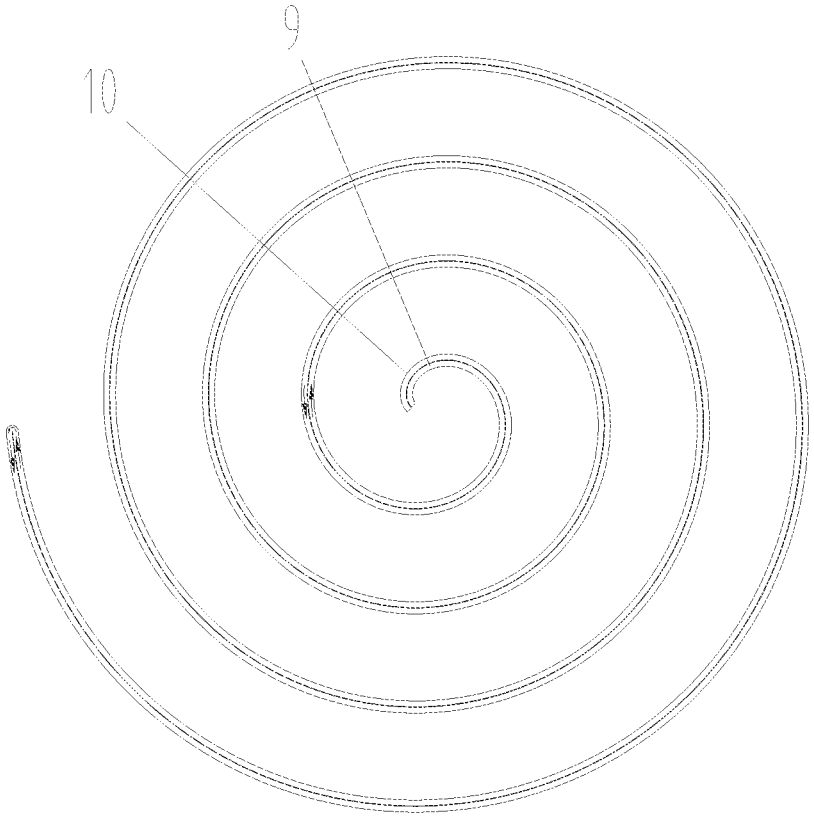
FIG. 6 is a schematic structure diagram of a part of a cooling pipe of a compressor in an orbiting scroll according to some embodiments of the present disclosure.

Referring to FIGS. 1 to 6 in combination, according to the embodiments of the present disclosure, the compressor and a part of the cooling pipe are arranged in the sealing portion of the orbiting scroll 1, and the cooling pipe moves synchronously with the orbiting scroll 1 and rotates with respect to the crankshaft 3.

The cooling pipe is arranged in the sealing portion of the orbiting scroll 1 of the compressor. Therefore, the sealing component 11 of the sealing portion can be cooled more effectively by the cooling pipe located in the sealing portion, and the cooling effect is better, thereby preventing the sealing components of the orbiting and stationary scrolls from being easy to wear and melt when operating in a higher temperature environment, and accordingly effectively prolonging the service life of the sealing component 11 and improving the overall reliability. At the same time, because the cooling pipe can move synchronously with the orbiting scroll 1 and rotate with respect to the crankshaft 3, the arrangement of the cooling pipe in the orbiting scroll 1 can be implemented smoothly without affecting the operation of the orbiting scroll, and meanwhile the orbiting scroll can be cooled more fully, which effectively solves the problem in the prior art that the arrangement of the cooling water pipe in the orbiting scroll 1 is difficult to implement due to the limitation of the motion state of the orbiting scroll 1. In this embodiment, a central axis of the crankshaft 3 is arranged horizontally.

The compressor further includes a bracket 2 and a drive motor 4. The bracket 2 provides a support structure for the installation of the crankshaft 3. The drive motor 4 is connected to the crankshaft 3 in a drivable mode to drive the crankshaft 3 to rotate, and then the crankshaft 3 drives the orbiting scroll 1 to move in translation, such that a space between the orbiting scroll 1 and the stationary scroll is continuously squeezed and changed to implement the compression of air.

In this embodiment, a pressure difference is formed between an inlet and an outlet of the cooling pipe, so that the coolant liquid flows from the inlet through the sealing portion and out of the outlet. By forming the pressure difference between the inlet and the outlet of the cooling pipe, the coolant liquid can be pressed from the inlet to the outlet under the action of the pressure difference, so that the flow of the cooling liquid can be directly implemented by using the action of the pressure difference without needing to add the cooling water circulation pump. Accordingly, the sealing component 11 of the orbiting scroll can be effectively sealed, and the structure of the whole machine is simpler and easier to implement.

In this embodiment, an axial through hole 16 is provided at the center of the orbiting scroll 1, a sealing groove 15 is provided in the sealing portion of the orbiting scroll 1, a mounting hole 17 is provided on the crankshaft 3, and the sealing groove 15 is in communication with the mounting hole 17 through the axial through hole 16; the cooling pipe enters from the tail portion 32 of the crankshaft 3, passes through the mounting hole 17, the axial through hole 16 and the sealing groove 15, and then returns back on the same way, and extends from the tail portion 32 of the crankshaft 3.

In this embodiment, the arrangement path of the cooling pipe on the orbiting scroll 1 is the same as the structure of the sealing groove 15 on the orbiting scroll 1, for example, a spiral shape. At this time, the cooling pipe is also arranged in the spiral shape, so as to ensure that the cooling pipe can fully distributed at various positions in the sealing groove 15 of the orbiting scroll 1, accordingly the sealing component 11 of the orbiting scroll 1 is cooled more effectively, the temperature of the sealing component 11 during operation is reduced, and the service life of the sealing component 11 is effectively increased.

In some embodiments, an eccentric amount of the mounting hole 17 relative to the central axis of the crankshaft 3 is the same as an eccentric amount of the orbiting scroll 1 relative to the central axis of the crankshaft 3, and the mounting hole 17 is arranged coaxially with an eccentric portion 34 of the crankshaft. Such structure can ensure that the cooling pipe is arranged inside the mounting hole 17 of the crankshaft 3 and that the cooling pipe has no movement with respect to the orbiting scroll 1. During the rotation of the crankshaft 3, the orbiting scroll 1 does not rotate in translation. The eccentric portion 34 of the crankshaft rotates on its own and revolves around the central axis of the crankshaft 3. The cooling pipe rotates with respect to the eccentric portion 34 of the crankshaft and moves in translation under the driving of the eccentric portion 34 of the crankshaft. Since the eccentric portion 34 of the crankshaft and the orbiting scroll 1 only relatively rotate, the cooling pipe that only rotates with respect to the eccentric portion 34 of the crankshaft can move in translation with the orbiting scroll 1, so that the cooling pipe can be arranged in the orbiting scroll 1.

In this embodiment, the cooling pipe is a water pipe that enters the mounting hole 17 from a tail portion of the crankshaft 3, and then passes through the axial through hole 16 to enter the sealing groove 15, and is arranged along the structure of the sealing groove 15. After reaching the tail portion 152 of the sealing groove 15, the water pipe returns back on the same way and enters the mounting hole 17 again through the axial through hole 16, and then passes through the mounting hole 17 to extend from the tail portion 32 of the crankshaft, thereby implementing the arrangement of the cooling pipe.

In some embodiments, the mounting hole 17 is a round hole; and/or, the axial through hole 16 is a round hole, so as to facilitate the arrangement of the cooling pipe in the mounting hole 17 and the axial through hole 16 without affecting the rotation of the cooling pipe with respect to the crankshaft 3, and the rotation resistance is smaller.

In this embodiment, the sealing portion further includes a sealing component 11 arranged in the sealing groove 15. A mounting groove 18 configured to mount the cooling pipe is formed between the sealing component 11 and the sealing groove 15, and the cooling pipe is in contact with the sealing component 11. The sealing component 11 of the orbiting scroll 1 is fastened on the inlet pipe 9 and the outlet pipe 10 arranged side by side; an inner side wall of the sealing component 11 is in contact with the cooling pipe, and an outer side wall of the sealing component 11 is in contact with the sealing groove 15, so as to implement effective heat exchange with the cooling pipe, and improve the heat exchange efficiency of the sealing component 11. Since the cooling pipe is directly in contact with the sealing component 11, the temperature of the sealing component 11 can be lowered more effectively.

In some embodiments, the width w of the mounting groove 18 in the axial direction of the orbiting scroll 1 is greater than or equal to the diameter d of the cooling pipe and less than 1.5 times the diameter d of the cooling pipe, so that the inlet pipe 9 and the outlet pipe 10 of the cooling pipe are capable of being arranged along the radial direction of the orbiting scroll as much as possible, rather than being arranged along the axial direction, accordingly both the inlet pipe 9 and the outlet pipe 10 can be in contact with the sealing component 11 as much as possible to further improve the cooling efficiency of the cooling pipe on the sealing component 11. In some embodiments, the width w of the mounting groove is equal to a diameter of the cooling pipe, so that the inlet pipe 9 and the outlet pipe 10 can be fully in contact with the sealing component 11 to form a more effective cooling effect.

In this embodiment, the mounting groove 18 is a rectangular groove or an elliptical groove; the inlet pipe 9 and the outlet pipe 10 of the cooling pipe are arranged side by side in the mounting groove 18, so that the inlet pipe 9 and the outlet pipe 10 can be arranged along a contact surface of the sealing component 11 as much as possible, to implement full contact with the sealing component 11.

In some embodiments, the tail portion 152 of the sealing groove 15 is bent in an arc shape, so that the cooling pipe can be bent back along the arc shape at the tail portion 152 of the sealing groove 15 of the orbiting scroll 1, thereby reducing the adverse effect of the change in the flow direction of the coolant liquid on the flow of the coolant liquid as much as possible, and accordingly improving the flow efficiency and the cooling effect of the coolant liquid.

In this embodiment, the compressor further includes a coolant liquid tank 5. The coolant liquid tank 5 includes a first cavity 13 and a second cavity 14 separated by a partition plate 6; and the partition plate 6 is provided with a throttle hole 12. The first cavity 13 is in communication with the second cavity 14 through the throttle hole 12; the outlet of the cooling pipe extends into the first cavity 13; the inlet of the cooling pipe extends into the second cavity 14; and the outlet of the cooling pipe is lower than the inlet of the cooling pipe, and the inlet and outlet of the cooling pipe can simultaneously extend below the liquid level.

In some embodiments, a communication port 19 is provided at the bottom of the partition plate 6; and the first cavity 13 is in communication with the second cavity 14 through the communication port 19.

Since the outlet of the cooling pipe is lower than the inlet of the cooling pipe, when the inlet and outlet of the cooling pipe simultaneously extend below the liquid level, a siphon phenomenon is formed for the coolant liquid in the first cavity 13 and the second cavity 14 through the cooling pipe, so that the coolant liquid can flow from the first cavity 13 to the second cavity 14 through the cooling pipe. During the flow of the coolant liquid, the heat on the sealing component 11 of the orbiting scroll 1 is taken away, thereby effectively performing the heat dissipation on the sealing component 11.

In this embodiment, when liquid level in the second cavity 14 drops below a certain height, the outlet of the cooling pipe is always below the liquid level in the first cavity 13; the crankshaft 3 has a first rotation angle which makes the inlet of the cooling pipe below the liquid level in the second cavity 14 and a second rotation angle which makes the inlet of the cooling pipe above the liquid level in the second cavity 14. Since the cooling pipe can rotate with respect to the crankshaft 3 and the cooling pipe is eccentrically arranged relative to the crankshaft 3, the cooling pipe rises and falls repeatedly with the rotation of the crankshaft 3 during the rotation of the crankshaft 3. Therefore, when the liquid level in the second cavity 14 is lowered to a certain height under the siphoning, and when the cooling pipe rotates to the very bottom, a pipe orifice of the inlet pipe 9 of the cooling pipe extends below the liquid level; and when the cooling pipe rotates to the highest point, the pipe orifice of the inlet pipe 9 of the cooling pipe extends out of the liquid level. At this time, the coolant liquid has two states of movement, when the pipe orifice of the inlet pipe 9 of the cooling pipe extends out of the liquid level, since the gas pressure in the first cavity 13 is higher than the gas pressure in the second cavity 14 and the two ends of the cooling pipe cannot form a siphon, the coolant liquid flows backwards through the outlet pipe 10 and the inlet pipe 9 to the second cavity 14 under the action of the gas pressure in the first cavity 13; when the pipe orifice of the inlet pipe 9 of the cooling pipe extends below the liquid level, the inlet pipe 9 and the outlet pipe 10 both extend below the liquid level, and the liquid level in the second cavity 14 is higher than the liquid level in the first cavity 13, the pipe orifice of the inlet pipe 9 is higher than the pipe orifice of the outlet pipe 10, accordingly a siphon phenomenon can be formed, such that the coolant liquid flows to the first cavity 13 through the inlet pipe 9 and the outlet pipe 10. Therefore, in the above process, the coolant liquid can also keep flowing, and cool the orbiting scroll 1 during the flowing.

For example, a coordinate system is established with a center of a cross section of the crankshaft as an origin. The coordinate system is divided into four quadrants. When the crankshaft rotates to a range of 45° to 135°, the pipe orifice of the cooling pipe 9 is higher and extends above the liquid level. When the crankshaft rotates to a range of 0° to 45° and a range of 135° to 360°, the pipe orifice of the cooling pipe 9 is lower and extends below the liquid level. At this time, it can be considered that the second rotation angle is formed when the crankshaft rotates to the range of 450 to 135°; and the first rotation angle is formed when the crankshaft rotates to the range of 0° to 45° and the range of 135° to 360°.

Since the eccentric amount of the orbiting scroll 1 with respect to the crankshaft 3 is actually smaller, the influence of the eccentric amount on the change in the height of the pipe orifice of the inlet pipe 9 during the rotation of the crankshaft 3 can also be ignored; and it is considered that the pipe orifice of the inlet pipe 9 is always below the liquid level in the second cavity 14 during the entire cooling cycle of the coolant liquid.

In some embodiments, the top of the first cavity 13 is provided with a connection port 7, and the first cavity 13 is in communication with the exhaust pressure through the connection port 7; and/or, the top of the second cavity 14 is provided with an opening 8, and the second cavity 14 is in communication with the atmosphere through the opening 8.

When the compressor does not operate or in a stop gap, since both the first cavity 13 and the second cavity 14 are in communication with the atmosphere, the liquid levels in the two cavities can be balanced. When the liquid level is stable, the height of liquid level in the first cavity 13 is the same as the height of the liquid level in the second cavity 14.

During the operation of the compressor, the exhaust pressure is introduced into the first cavity 13 through the connection port 7. The pressure in the first cavity 13 gradually increases due to the partition of the partition plate 6 and the throttling effect of the throttle hole 12. The second cavity 14 is in communication with the atmosphere through the opening 8; the liquid level in the first cavity 13 decreases, the liquid level in the second cavity 14 rises, the outlet pipe 10 extends into the liquid in an initial state, and the inlet pipe 9 is exposed in the air; since the pressure in the first cavity 13 increases, when the pressure in the first cavity 13 reaches a certain value, the coolant liquid can be forced to enter from the outlet pipe 10 and flow out of the inlet pipe 9, this moment the liquid fills the entire cooling pipe.

When the liquid level in the second cavity 14 is higher than the liquid level in the first cavity 13 by a certain value, the sum of the gas pressure and the liquid pressure in the first cavity 13 and the sum of the gas pressure and the liquid pressure in the second cavity 14 tends to balance. When the two sums reach equilibrium and the liquid levels are stable, the liquid level in the first cavity 13 is lower, and the liquid level in the second cavity 14 is higher. During the rotation of the crankshaft 3, the inlet pipe 9 is immersed in the higher liquid level in the second cavity 14. By using the siphon principle, the cooling water enters from the inlet pipe 9 and flows out of the outlet pipe 10, accordingly the circulation of the cooling water is implemented. In some embodiments, due to the existence of the throttle hole 12, the gas in the first cavity 13 always flows toward the second cavity 14 with a lower pressure, such that the sum of the gas pressure and liquid pressure in the first cavity 13 and the sum of the gas pressure and liquid pressure in the second cavity 14 always tend to balance. When the sum of the gas pressure and liquid pressure in the first cavity 13 and the sum of the gas pressure and liquid pressure in the second cavity 14 reach equilibrium, this moment due to the existence of the liquid level difference, the coolant liquid continues to flow from the second cavity 14 into the first cavity 13 through the cooling pipe, to cool the sealing component 11 of the orbiting scroll 1, and then the gas pressure in the second cavity 14 continues to rise to make the sum of the gas pressure and liquid pressure in the first cavity 13 and the sum of the gas pressure and liquid pressure in the second cavity 14 reach equilibrium again, so that the coolant liquid can always flow toward the first cavity 13 with a lower liquid level under the siphoning.

When the stop gap of the compressor is reached, both the first cavity 13 and the second cavity 14 are in communication with the atmosphere, such that the liquid levels in the two cavities can be balanced again, thereby implementing the circulation flow cooling of the coolant liquid.

Since the crankshaft 3 can rotate in a range of 360°, when the liquid level drops below a certain height during the rotation of the crankshaft 3, the cooling pipe moves up and down with the eccentric portion 34 of the crankshaft 3. In some embodiments, the cooling pipe extends below the liquid level in the second cavity 14 or above the liquid level in the second cavity 14 with different heights of the eccentric portion 34 of the crankshaft, accordingly the cooling pipe is continuously located below the liquid level in the second cavity 14 within a certain angle range of the rotation of the crankshaft 3. In this process, the inlet pipe 9 and outlet pipe 10 of the cooling pipe can form a siphon phenomenon between the coolant liquids in the first cavity 13 and the second cavity 14, thereby implementing the flow inside the pipe.

In some embodiments, the cooling pipe is a flexible pipe, which is more convenient to implement the cooling pipe according to the structure of the sealing component 11 of the orbiting scroll 1, which reduces the difficulty in arranging the cooling pipe and improves the cooling effect of the cooling pipe on the sealing component 11.

In some embodiments, the cooling pipe inside the mounting hole 17 is sheathed with a protective sleeve. Since the cooling pipe rotates relative to the mounting hole 17, a rotational friction is generated between the cooling pipe and the mounting hole 17, which can easily cause wear to the cooling pipe and reduce the service life of the cooling pipe. By arranging a protective sleeve outside the cooling pipe, the cooling pipe can be protected by the protective sleeve, thereby avoiding the friction between the cooling pipe and the mounting hole 17 and extending the service life of the cooling pipe.

In some embodiments, the inlet pipe 9 and the outlet pipe 10 of the cooling pipe are respectively sheathed with protective sleeves; the protective sleeve outside the inlet pipe 9 extends to a pendulous section of the inlet pipe 9, and the protective sleeve outside the outlet pipe 10 extends to a pendulous section of the outlet pipe 10. By controlling the length of the protective sleeve, the pendulous sections of the inlet pipe 9 and the outlet pipe 10 can be conveniently adjusted to appropriate positions, which makes it easier to implement the arrangement of the cooling pipe, and meanwhile prevents the structure of the crankshaft 3 from causing damage to the structure of the cooling pipe, such that it is easier for the cooling pipe to implement the flow and circulation of the coolant liquid between the first cavity 13 and the second cavity 14.

In the above-mentioned embodiments of the present disclosure, the direct contact between the cooling pipe and the sealing component 11 can reduce the temperature of the sealing component 11, thereby improving the reliability of the sealing component 11. Since the cooling pipe in the present disclosure uses the siphon principle to implement the circulation flow of the cooling water, there is no need to add a circulating pump separately, and the structure of the whole machine is simpler.

It is easy for those skilled in the art to understand that, on the premise of no conflict, the above advantageous modes can be freely combined and superimposed.

The above embodiments are merely preferred embodiments of the present disclosure, and are not intended to limit the disclosure. Any modification, equivalent replacement and improvement made within the spirit and principle of the present disclosure shall fall within the protection scope of the present disclosure. The above are merely the preferred embodiments of the present disclosure. It should be pointed out that those of ordinary skill in the art can make several improvements and variations without departing from the technical principles of the present disclosure, and these improvements and variations should also be regarded as in the scope of protection of the present disclosure.

What is claimed is:

1. A compressor, comprising a bracket, an orbiting scroll, a cooling pipe and a crankshaft comprising a mounting hole, the cooling pipe passing through the crankshaft by extending in the mounting hole and through an axial through hole provided in a center of the orbiting scroll, and a part of the cooling pipe being arranged in a sealing portion of the orbiting scroll at an end of the axial through hole, the bracket supporting the crankshaft, the drive motor being connected to the crankshaft in a drivable mode to drive the crankshaft to rotate, the crankshaft thereby driving the orbiting scroll to move in translation, wherein an eccentric amount of the mounting hole with respect to a central axis of the crankshaft is equal to an eccentric amount of the orbiting scroll with respect to the central axis of the crankshaft, and the mounting hole is arranged coaxially with an eccentric portion of the crankshaft, such that the cooling pipe moving synchronously with the orbiting scroll and rotating with respect to the crankshaft; wherein the sealing portion of the orbiting scroll comprises a sealing groove and a sealing component arranged in the sealing groove.

2. The compressor according to claim 1, wherein a pressure difference is formed between an inlet pipe portion and an outlet pipe portion of the cooling pipe, such that a coolant liquid flows from the inlet pipe portion through the sealing portion and out of the outlet pipe portion.

3. The compressor according to claim 2, wherein the sealing groove is in communication with the mounting hole through the axial through hole, the cooling pipe enters a tail portion of the crankshaft, and passes through the mounting hole, the axial through hole and the sealing groove, and then returns back on the same way and extends from the tail portion of the crankshaft.

4. The compressor according to claim 3, wherein (i) the mounting hole is a round hole, or (ii) the axial through hole is a round hole, or (iii) the mounting hole is a round hole and the axial through hole is a round hole.

5. The compressor according to claim 3, wherein a mounting groove configured to mount the cooling pipe is formed between the sealing component and the sealing groove, and the cooling pipe is in contact with the sealing component.

6. The compressor according to claim 5, wherein a width of the mounting groove in a length direction of the cooling pipe is greater than a diameter of the cooling pipe and less than 1.5 times the diameter of the cooling pipe.

7. The compressor according to claim 5, wherein the mounting groove is a groove having a rectangular cross section or an elliptical cross section, and the inlet pipe portion and the outlet pipe portion of the cooling pipe are arranged side by side in the mounting groove.

8. The compressor according to claim 3, wherein a tail portion of the sealing groove is bent in an arc shape.

9. The compressor according to claim 3, further comprising a coolant liquid tank, wherein the coolant liquid tank comprises a first cavity and a second cavity separated by a partition plate, the partition plate is provided with a throttle hole, the first cavity is in communication with the second cavity through the throttle hole, a pipe orifice of the outlet pipe portion of the cooling pipe extends into the first cavity, a pipe orifice of the inlet pipe portion of the cooling pipe extends into the second cavity, the pipe orifice of the outlet pipe portion of the cooling pipe is lower than the pipe orifice of the inlet pipe portion of the cooling pipe, and the pipe orifice of the inlet pipe portion and the pipe orifice of the outlet pipe portion of the cooling pipe are capable of simultaneously extending below a liquid level.

10. The compressor according to claim 9, wherein the pipe orifice of the outlet pipe portion of the cooling pipe is located below the liquid level in the first cavity, the crankshaft has a first rotation angle making the pipe orifice of the inlet pipe portion of the cooling pipe located below the liquid level in the second cavity and a second rotation angle making the pipe orifice of the inlet pipe portion of the cooling pipe located above the liquid level in the second cavity.

11. The compressor according to claim 9, wherein (i) a top of the first cavity is provided with a connection port, the first cavity being in communication with an exhaust pressure through the connection port, or (iii) a top of the second cavity is provided with an opening, the second cavity being in communication with atmosphere through the opening, or (iii) a top of the first cavity is provided with a connection port, the first cavity being in communication with an exhaust pressure through the connection port, and a top of the second cavity is provided with an opening, the second cavity being in communication with atmosphere through the opening.

12. The compressor according to claim 9, wherein a bottom end of the partition plate is provided with a communication port connecting the first cavity and the second cavity.

13. The compressor according to claim 3, wherein the cooling pipe is a flexible pipe.

14. The compressor according to claim 13, wherein the cooling pipe in the mounting hole is sheathed with a protective sleeve.

15. The compressor according to claim 14, wherein the inlet pipe portion and outlet pipe portion of the cooling pipe are respectively sheathed with the protective sleeves, the protective sleeve outside the inlet pipe portion extends to a pendulous section of the inlet pipe portion, and the protective sleeve outside the outlet pipe portion extends to a pendulous section of the outlet pipe portion.

* * * * *